US010829976B2

(12) United States Patent
Bendefy

(10) Patent No.: US 10,829,976 B2
(45) Date of Patent: Nov. 10, 2020

(54) LID STAY FOR FURNITURE

(71) Applicant: Flap Competence Center kft, Budapest (HU)

(72) Inventor: Andras Bendefy, Budapest (HU)

(73) Assignee: Flap Competence Center kft, Budapest (HU)

( * ) Notice: Subject to any disclaimer, the term of this patent is extended or adjusted under 35 U.S.C. 154(b) by 0 days.

(21) Appl. No.: 16/260,766

(22) Filed: Jan. 29, 2019

(65) Prior Publication Data

US 2019/0234127 A1 Aug. 1, 2019

(30) Foreign Application Priority Data

Jan. 31, 2018 (EP) ..... 18154405

(51) Int. Cl.
*E05F 1/10* (2006.01)

(52) U.S. Cl.
CPC ..... *E05F 1/1083* (2013.01); *E05F 1/1058* (2013.01); *E05Y 2201/48* (2013.01); *E05Y 2201/638* (2013.01); *E05Y 2900/20* (2013.01)

(58) Field of Classification Search
CPC ..... E05F 1/1083; E05F 1/1058
See application file for complete search history.

(56) References Cited

U.S. PATENT DOCUMENTS 2,566,691 A * 9/1951 Bristol ..... E05F 1/1083 267/159
5,103,532 A 4/1992 Youngdale et al.
7,240,974 B2 * 7/2007 Hirtsiefer ..... E05D 15/262 312/109
2004/0239213 A1 * 12/2004 Hirtsiefer ..... E05D 15/262 312/109
2005/0218383 A1 * 10/2005 Hirtsiefer ..... E05D 3/14 254/1
2010/0109497 A1 5/2010 Blersch et al.
2012/0118842 A1 5/2012 Salice
2015/0298904 A1 * 10/2015 Sherrard ..... B65F 1/1473 16/73

(Continued)

FOREIGN PATENT DOCUMENTS

CN 101636548 1/2010
CN 204511111 7/2015
CN 105683472 6/2016

(Continued)

OTHER PUBLICATIONS

Office Action received from China National Intellectual Property Administration for Application No. 201910089173.8, dated Apr. 29, 2020.

*Primary Examiner* — Jeffrey O'Brien
(74) *Attorney, Agent, or Firm* — Burris Law, PLLC

(57) ABSTRACT

A lid stay for furniture includes a setting arm pivotably attached on a base element around a first setting axis between an open position and a closed position, and an energy accumulator coupled to the setting arm. The setting arm is acted upon by a force along at least a part of the pivot path of the setting arm between the open position and/or closed position and the energy accumulator includes a flat spring which is made from a plate-like flat material and the flat spring is elastically supported against the base element and the setting arm in a plate plane of the flat material.

20 Claims, 5 Drawing Sheets

(56) References Cited

U.S. PATENT DOCUMENTS

2016/0168896 A1 6/2016 Holzapfel

FOREIGN PATENT DOCUMENTS

| | | | |
|---|---|---|---|
| DE | 3236328 | | 5/1983 |
| DE | 10223026 | | 2/2004 |
| DE | 102017108197 | | 10/2018 |
| EP | 1296011 | | 3/2003 |
| EP | 1835107 | | 9/2007 |
| JP | 2003129741 | | 5/2003 |
| WO | 2012116866 | | 9/2012 |
| WO | WO2012116866 | * | 9/2012 |

* cited by examiner

LID STAY FOR FURNITURE

CROSS-REFERENCE TO RELATED APPLICATIONS

This application is a continuation of European Patent Application No. 181544057, filed on Jan. 31, 2018. The disclosure of the above application is incorporated herein by reference.

FIELD

The present disclosure relates to a lid stay for [[a]] furniture having a setting arm, which is pivotably attached on a base element around a first setting axis between an open position and a closed position, and having an energy accumulator which is coupled to the setting arm in such a way that the setting arm is subjected to force along at least a part of the pivot path of the setting arm in direction towards the open position or closed position.

BACKGROUND

The statements in this section merely provide background information related to the present disclosure and may not constitute prior art.

DE 102 23 026 B3 describes a lid stay with a setting slider which is guided linearly displaceably in a housing. The setting slider has a roller which is rotatably mounted on the setting slider. The roller is acted upon by a force into abutment to a setting contour of the setting arm. For this, helical springs are used, which urge the setting slider and, thus, the roller against the setting contour. A comparable lid stay is also shown in EP 1 296 011 A1.

In specific applications, it can be disadvantageous, that these lid stays use helical springs. To provide the necessary force for holding or moving a lid, the helical springs have a proportionally large diameter. This leads to the fact, that the whole lid stay is formed relative thick in direction of the first pivot axis. This means, that the lid stay projects relatively far into the interior of the body of the furniture.

SUMMARY

In order to provide a lid stay, which is formed as slim as possible, a lid stay for a furniture has a setting arm which is pivotably attached on a base element around a first setting axis between an open position and a closed position, and an energy accumulator which is coupled to the setting arm in such a way that the setting arm is subjected to force along at least a part of the pivot path of the setting arm in direction towards the open position or the closed position. The energy accumulator comprises a flat spring, made from a plate-like flat material, wherein the flat spring is supported elastically on the base element and the setting arm in a plate plane of the flat material.

The flat spring from a plate-like material is elastically loaded in the plate plane of the flat material. The terms "plate-like" and "flat material" mean in this connection, that the flat spring has a larger extension in a width direction and a length direction than in a thickness direction transversally to the plate plane. The flat spring is still to be regarded as plate-like in the sense of this disclosure if at least the essential part of the flat spring is arranged in the plate plane and potentially some areas are bent thereto. The flat spring is deformed elastically in the plate plane of the flat material and not, like a leaf spring, transversally to the plate plane of the flat material. Thus, a very thin structure of the lid stay is ensured.

In this case, the flat spring is formed in the plate plane (parallel) to the plate plane elastically, so that the flat spring takes up along its plate thickness (thickness direction) no installation space. The plate plane is the plane, which is formed by the plate-like material. The plate thickness means the thickness of the plate-like material.

The flat spring may be manufactured from metal sheet. Thus, standard materials, like steel materials, especially spring steel, is used, which have been tried and tested in the manufacture of spring elements because of their flexibility and durability. Generally the flat spring can however also be manufactured from a different material, like for example fibre-reinforced plastics or a composite component from metal and fibre-reinforced plastics.

In one example the flat spring can be formed U-like in the plate plane of the flat material and forms a first spring arm and a second spring arm, wherein the first spring arm is connected to the base element and the second spring arm is coupled to the setting arm for the force application.

The U-like flat spring can be formed such, that the two spring arms are connected to each other via a turn section.

The first spring arm has a first free end, with which the flat spring is connected, preferably rotatably, to the base element. Furthermore, the second spring arm may have a second free end, with which the flat spring is coupled to the setting arm. Thus, an as large as possible length of the flat spring can be used from the first free end up to the second free end.

The spring arms can be formed tapered up to the free ends. Herein, the plate thickness does not change. Furthermore, the flat spring can be formed tapered from an apex of the turn section to the free ends in the plate plane.

In an example, the second spring arm is coupled via a coupling device to the setting arm.

The coupling device can have a setting contour on the setting arm which extends at a changing distance to the first setting axis. In this case, the coupling device can further have a pressure element which is acted upon by a force of the flat spring against the setting contour.

The pressure element can for example be arranged on a pivot arm which is connected pivotably to the base element wherein the second spring arm is acted on against the pivot arm. Thus, the degrees of freedom for the movement of the flat spring and the coupling device are defined.

Herein, the second spring arm can be connected, for instance rotatably, to the pivot arm.

The pressure element can be a roller which is rotatably attached on the pivot arm.

Alternatively, the flat spring can be formed S-like or W-like in the plate plane of the flat material. Other forms are also possible, like for example several wave-like portions, arranged one after the other and which are connected at their facing wave crests to each other, or any grid structures.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
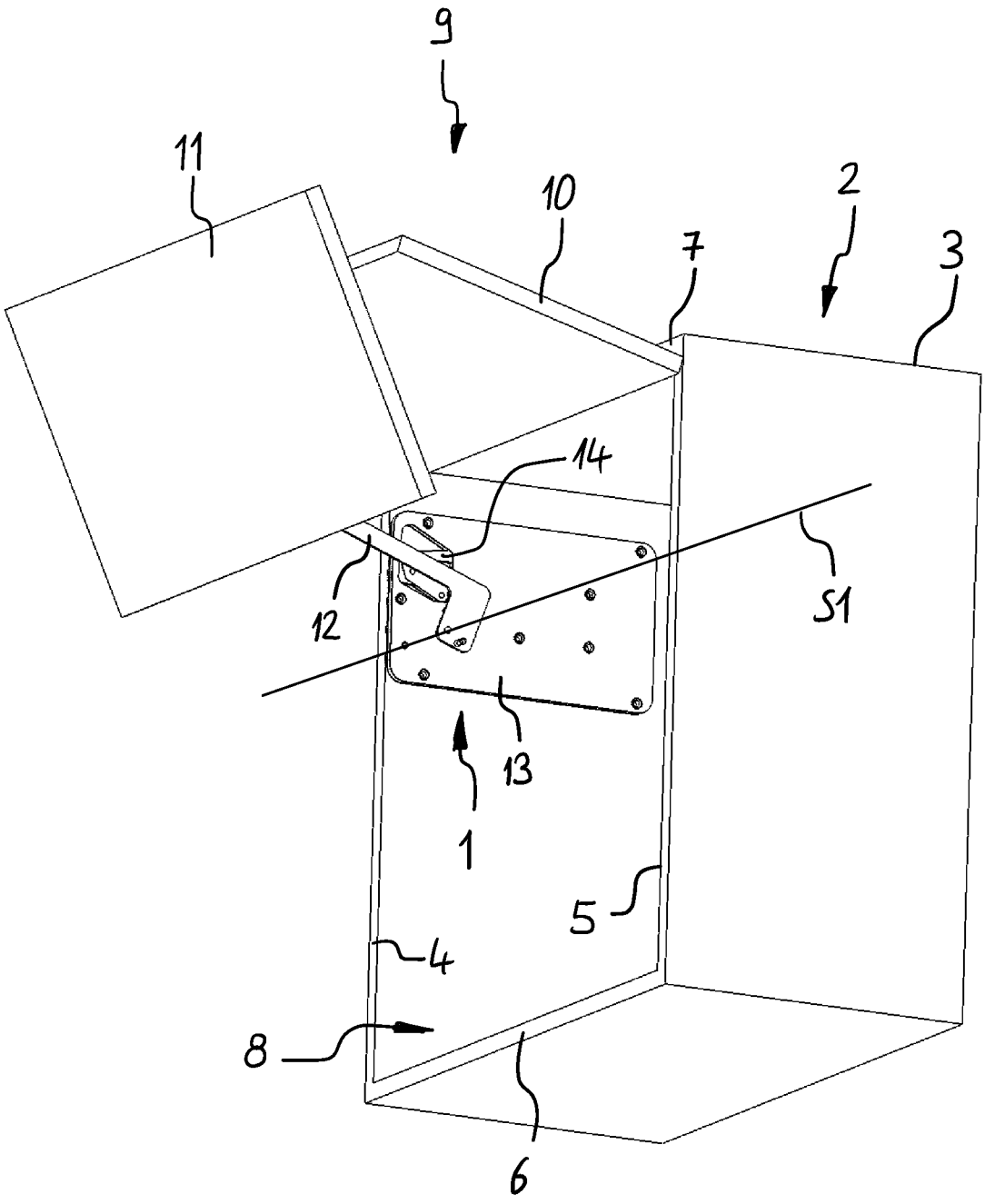
FIG. 1 is a perspective representation of a furniture with a lid stay in the open position with a first embodiment of a flat spring.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
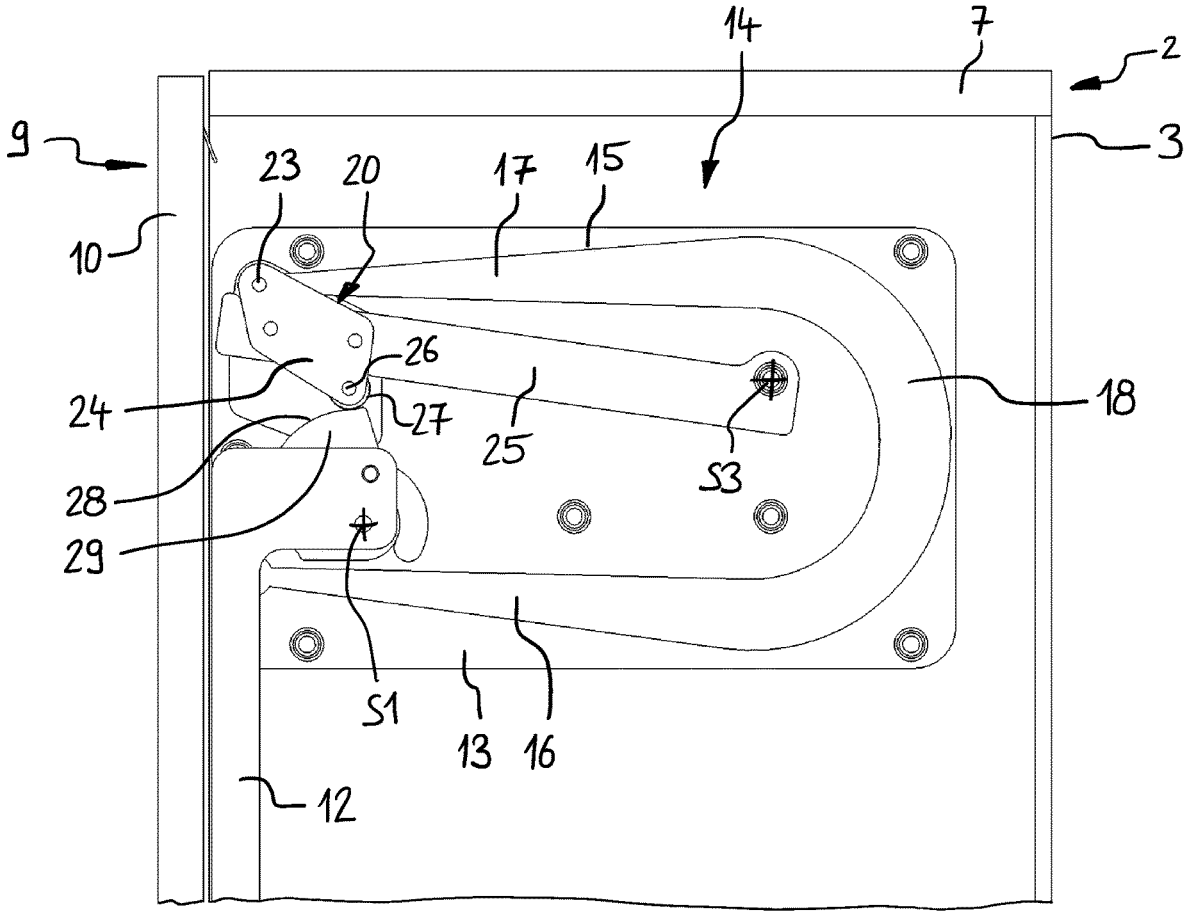
FIG. 2 is a partial side view of the furniture body and of the lid stay of FIG. 1 with the lid stay in its closed position.
Figure 3:
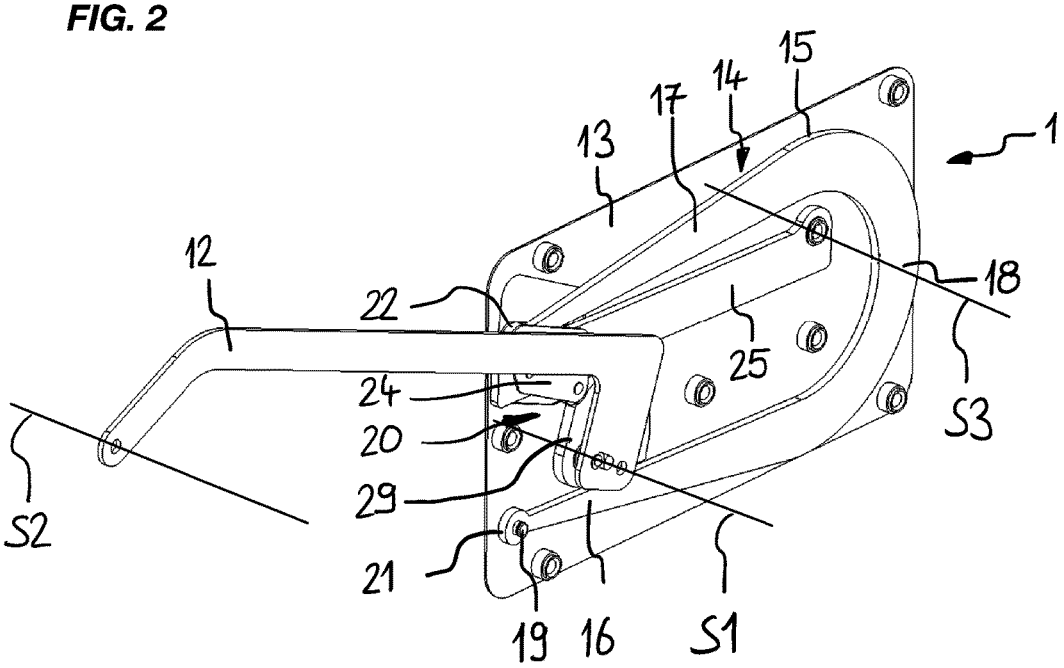
FIG. 3 is a perspective representation of a lid stay of FIG. 1 in its open position.

FIGS. 1 to 3 show a lid stay shown partially assembled in a body of a furniture, wherein the Figures are described together in the following.

FIG. 1 shows a lid stay 1 mounted in a furniture 2. The furniture 2 comprises a body 3 with two side walls 4, 5, a lower shelf 6 and an upper shelf 7. The side walls 4, 5, the lower shelf 6 and the upper shelf 7 form together an opening 8, which is closed by a folding lid 9. In FIG. 1 the folding lid is shown in an open position. The folding lid has an upper lid half 10 which is pivotably connected around a horizontally arranged axis in the area of the upper shelf 7 6 to the body 3. The upper lid half 10 is pivotably connected to a lower lid half 11.

The lid stay 1 is mounted on one of the side walls 4, wherein a setting arm 12 of the lid stay 1 is pivotably connected around a first pivot axis S1 to a base element 13 of the lid stay 1 between an open position (FIGS. 1 and 3) and a closed position (FIG. 2). The first pivot axis S1 is arranged horizontally. Furthermore, the setting arm 12 is pivotably connected to the lower lid half 11 of the folding lid 9 around a second pivot axis S2, which is arranged parallel to the first pivot axis S1.

Generally, the lid stay 1 can be connected also to a simple lid, i.e. a lid, which is not foldable. Furthermore, the lid stay 1 can also be provided as a fitting, which at the same time serves as hinge for the lid, so that the lid does not have to be connected via a further hinge to the body.

The base element has a covering plate, which is shown in FIG. 1. In FIGS. 2, 3 the covering plate is not shown, so that the interior of the lid stay 1 is visible.

On the base element 13, an energy accumulator 14 is provided which is coupled to the setting arm 12 in such a way that the setting arm 12 is subjected to a force along at least a part of its pivot path between the open position and the closed position, e.g., between an intermediate position and the open position and/or between an intermediate position and the closed position wherein the intermediate position is arranged between the open position and the closed position. For this, the energy accumulator 14 has a flat spring 15 which is manufactured from a plate-like elastic material, for instance a sheet made from a metal material. In this context, plate-like means that the flat spring is many times thinner in the direction of its thickness than in a direction transverse to the thickness direction. The flat spring 15 has a first spring arm 16 and a second spring arm 17 which are connected to each other via a turn section 18. The first spring arm 16 has a first free end 21 and the second spring arm 17 has a second free end 22. The two free ends 21, 22 face at least approximately in the same direction.

The first free end 21 of the first spring arm 16 is pivotably connected to the base element 13. For this, the first free end 21 is connected via a rivet 19 to the base element 13, so that the first spring arm 16 can pivot around the rivet 19.

The second free end 22 of the second spring arm 17 is coupled via a coupling device 20 to the setting arm 12. In this case, the flat spring 15 is biased such, that a force of the second spring arm 17 acts on the setting arm 12. In the present case, the two spring arms 16, 17 are biased away from each other, so that these act with a force towards each other.

This means, that the flat spring 15 is biased in the plate plane of the plate-like material. The plate plane corresponds to the drawing page plane in FIGS. 2 and 4 to 8.

The coupling device 20 comprises an assembly unit 24, on which the second free end 22 of the second spring arm 17 is pivotably connected via a bolt 23. The assembly unit 24 is fixed to a pivot arm 25 which is connected pivotably around a third pivot axis S3 to the base element 13. The third pivot axis S3 is arranged parallel to the first pivot axis S1 and the second pivot axis S2.

A roller 27 is rotatably supported via a bolt 26 on the assembly unit 24. The roller 27 is acted on by a force against a setting contour 28 of a cam disc 29, wherein the cam disc 29 is fixed to the setting arm 12. The cam disc 29 is connected in the shown embodiment to the setting arm 12 for example by rivets. It is, however, also generally possible, that the cam disc is an integral part of the setting arm 12.

Alternatively, the second spring arm 17 can also be coupled directly, i.e. not via an assembly unit, to the pivot arm 25. Also the roller 27 can be arranged directly rotatably on the pivot arm 25. Alternatively to the roller 27, also a pressure piece can be held in sliding abutment to the setting contour 28.

By means of the spring force of the flat spring 15 or of the second spring arm 17, the roller 27 is pressed against the setting contour element 29.

The setting contour 28 has a changing distance along its extension to the first pivot axis S1 (i.e., between an outer edge of the setting contour 28 where the roller 27 contacts the cam disc 29 and the first pivot axis S1), so that thus a force of the roller 27 acts on the setting arm 12, which causes a torque in the pulling-in direction to the closed position and/or in the direction to the open position.

For example, the setting contour 28 can be formed such that the radial distance of the setting contour 28 to the first pivot axis S1 in the contact area between the roller 27 and the setting contour 28 decreases via a pivot path starting from an intermediate position of the setting arm 12 between an open position and a the closed position in the direction towards the open position via an angular path of the setting arm 12. Thus, for example it can be ensured, that the setting arm 12 is acted upon by a force across the largest angular path, which produces a torque in the direction to the open position. Across the angular path, starting from the intermediate position to the closed position, the setting contour 28 can have a shape, across which extension the radial distance between an outer edge of the setting contour 28 where the roller 27 contacts the cam disc 29 decreases to the first setting axis S1. Thus, along this pivot path a torque is produced, which urges the setting arm 12 to the closed position. In this case, the setting contour 28 can be formed such, that the produced torque corresponds in each pivot position of the setting arm 12 to a that counter-torque, which is produced in total by the weight force of the lid 9, so that the lid 9 is held in any position between the open position and the intermediate position by the lid stay 1.

FIGS. 4 to 8 show exemplary further embodiments of flat springs, wherein components or elements, which correspond to those of the first embodiment, are provided with the same reference numerals and are described with the first embodiment.

Figure 4:
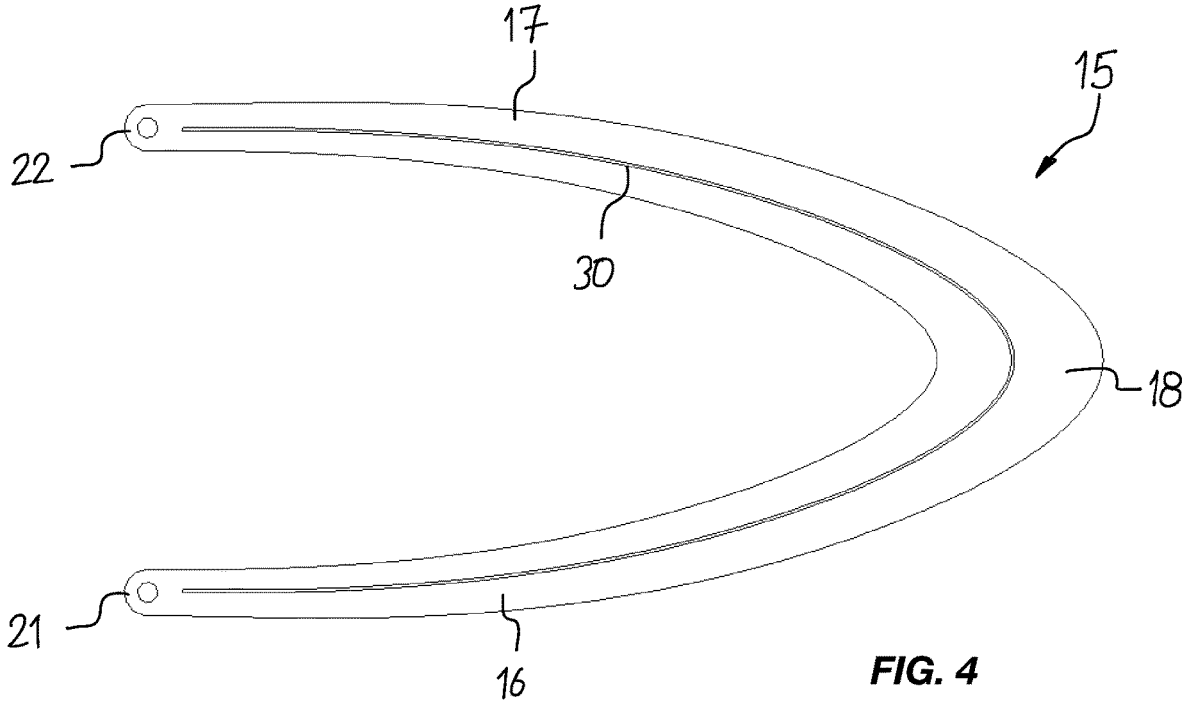
FIG. 4 is a top view of a second embodiment of a flat spring in U-shape.
Figure 5:
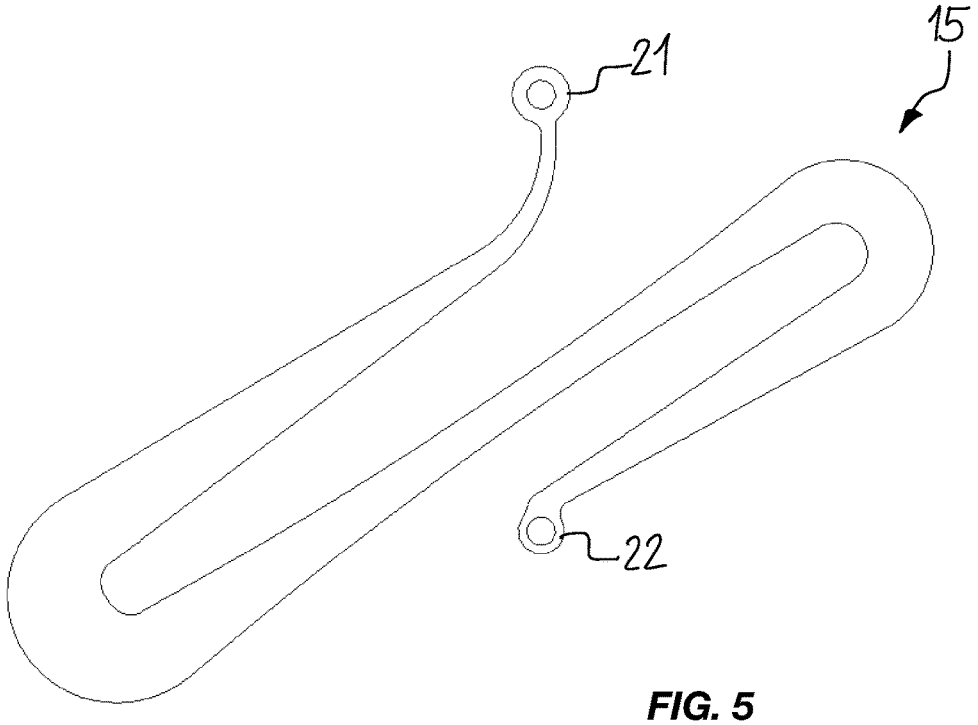
FIG. 5 is a top view of a third embodiment of a flat spring in S-shape.
Figure 6:
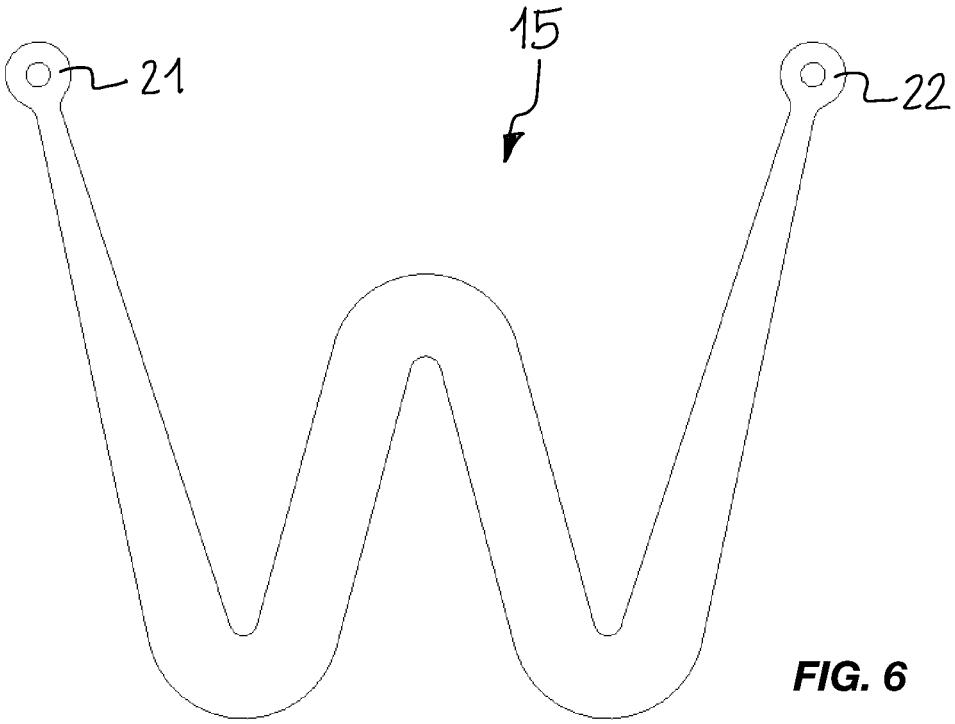
FIG. 6 is a top view of a fourth embodiment of a flat spring in W-shape.
Figure 7:
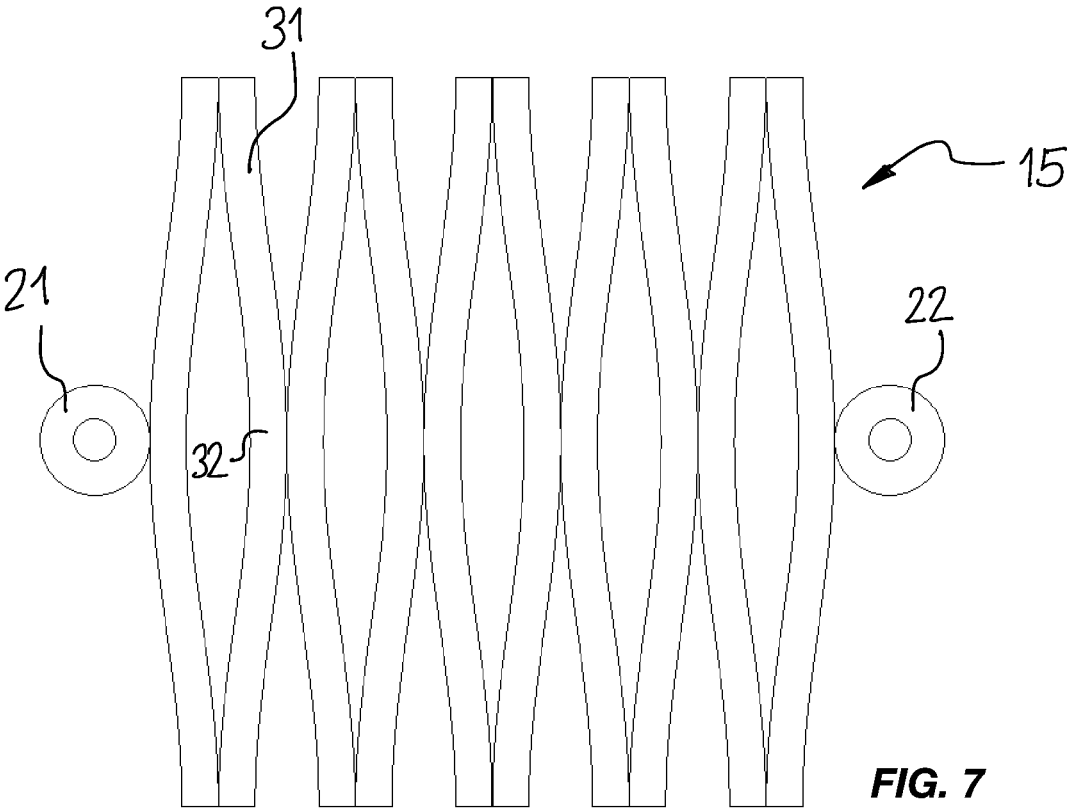
FIG. 7 is a top view of a fifth embodiment of a flat spring in wave shape.
Figure 8:
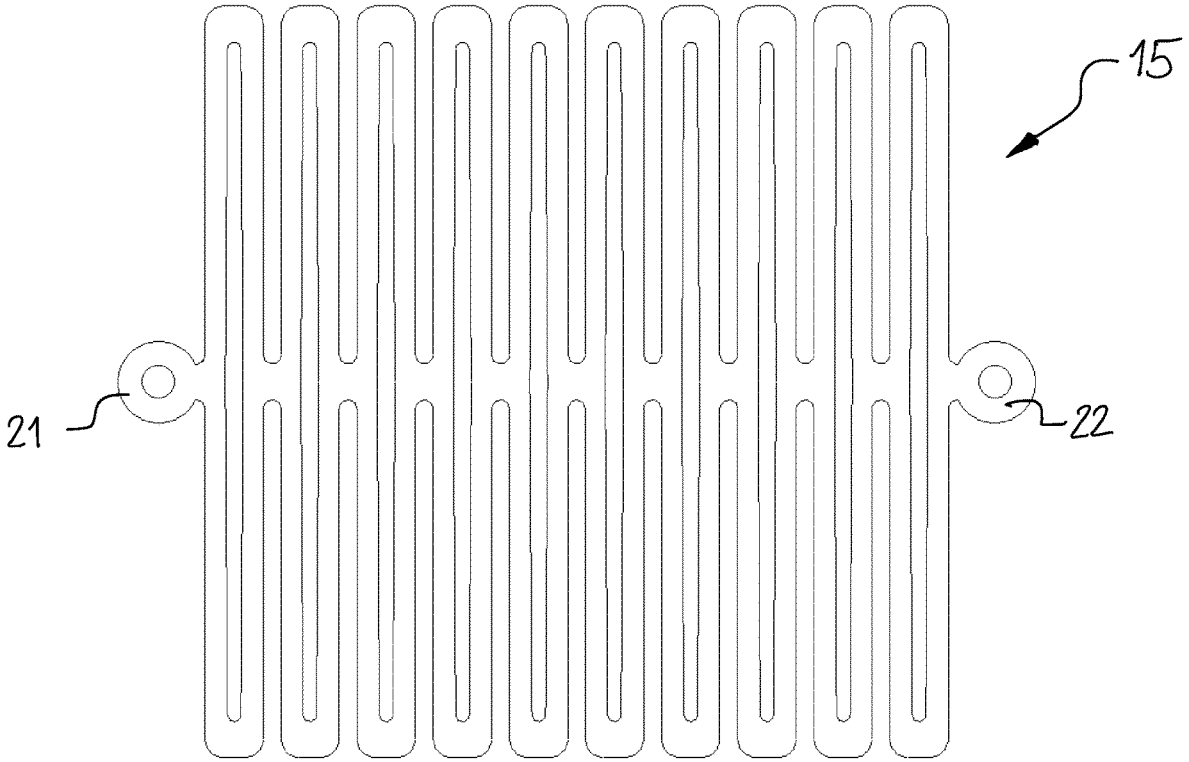
FIG. 8 is a top view of a sixth embodiment of a flat spring in grid shape.

FIG. 4 shows a top view of a flat spring in U-shape, wherein along the extension of the flat spring within the U-shaped portion a slot 30 is provided, which ensures an increased elasticity of the flat spring in the plate plane. FIG. 5 shows a flat spring in S-shape. FIG. 6 shows a flat spring in W-shape. FIG. 7 shows a flat spring in wave shape, in which several wave-like elements 31 are arranged one behind the other, wherein the wave-like elements 31 are connected at their neighbouring wave crests 32 to each other. The individual elements can be joined together or can be integrally connected to each other. FIG. 8 shows a flat spring with a grid structure.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A lid stay for furniture, comprising:

a setting arm pivotably attached on a base element around a first setting axis, wherein the setting arm is movable between an open position and a closed position, and an energy accumulator coupled to the setting arm such that the setting arm is subjected to force over at least a part of a pivot path of the setting arm between the open position and/or the closed position, wherein the energy accumulator comprises a flat spring made from a plate-shaped flat material defining a plate plane, said flat spring comprising a spring arm with a width and a length in the plate plane that is greater than a thickness of the spring arm transverse to the plate plane, and wherein the flat spring is elastically supported against the base element and the setting arm and elastically deformed in the plate plane of the plated-shaped flat material.

2. The lid stay according to claim 1, wherein the flat spring is manufactured from sheet metal.

3. The lid stay according to claim 1, wherein the flat spring is formed U-like in the plate plane of the flat material and forms a first spring arm and a second spring arm, wherein the first spring arm is connected to the base element and the second spring arm is coupled to the setting arm.

4. The lid stay according to claim 3, wherein the two spring arms are connected to each other via a turn section.

5. The lid stay according to claim 3, wherein the first spring arm has a first free end, with which the flat spring is connected to the base element, and the second spring arm has a second free end, with which the flat spring is coupled to the setting arm.

6. The lid stay according to claim 5, wherein the second spring arm is coupled via a coupling device to the setting arm.

7. The lid stay according to claim 6, wherein the coupling device has a setting contour on the setting arm, which extends at a changing distance to the first setting axis, and the coupling device further has a pressure element, which is acted upon by a force of the flat spring against the setting contour.

8. The lid stay according to claim 7, wherein the pressure element is arranged on a pivot arm pivotably connected to the base element such that the second spring arm is acted on against the pivot arm.

9. The lid stay according to claim 7, wherein the pressure element is a roller rotatably attached on the pivot arm.

10. The lid stay according to claim 3, wherein the second spring arm is connected to the pivot arm.

11. The lid stay according to claim 1, wherein the flat spring is formed S-shaped, W-shaped, wave-shaped or grid-shaped in the plate plane of the plate-shaped flat material.

12. The lid stay according to claim 1 further comprising a lid pivotally connected to the setting arm.

13. The lid stay according to claim 12, wherein the lid is a folding lid.

14. The lid stay according to claim 12 further comprising a piece of furniture, wherein the lid stay and the lid are attached to the piece of furniture.

15. A lid stay for furniture, comprising:

a setting arm pivotably attached on a base element around a first setting axis, wherein the base element is attached to a wall of a piece of furniture and the setting arm is movable between an open position and a closed position, and an energy accumulator coupled to the setting arm such that the setting arm is subjected to force over at least a part of a pivot path of the setting arm between the open position and the closed position, wherein the energy accumulator comprises a flat spring made from a plate-shaped flat material defining a plate plane, said flat spring comprising a first spring arm with a width and a length in the plate plane that is greater than a thickness of the first spring arm and a second spring arm with a width and a length in the plate plane that is greater than a thickness of the second spring arm, wherein the flat spring is formed U-shaped in the plate plane of the plate-shaped flat material and the first spring arm is connected to the base element and the second spring arm is coupled to the setting arm, and wherein the flat spring is elastically supported against the base element and the setting arm and elastically deformed in the plate plane of the plate-shaped flat material.

16. The lid stay according to claim 15, wherein the first spring arm has a first free end connected to the base element and the second spring arm has a second free end coupled to the setting arm.

17. The lid stay according to claim 16, wherein the second spring arm is coupled via a coupling device to the setting arm.

18. The lid stay according to claim 17, wherein the coupling device comprises a cam disc with a setting contour on the setting arm.

19. A lid stay for furniture, comprising:

a setting arm pivotably attached on a base element around a first setting axis and a lid pivotally connected to the setting arm, wherein the setting arm and the lid are movable between an open position and a closed position, and an energy accumulator coupled to the setting arm such that the setting arm is subjected to force over at least a part of a pivot path of the setting arm between the open position and the closed position, wherein the energy accumulator comprises a flat sheet metal spring formed U-shaped in a plate plane of the flat sheet metal, said flat sheet metal spring comprising a spring arm with a width and a length in the plate plane that is greater than a thickness of the spring arm transverse to the plate plane, the spring arm comprising a first spring arm connected to the base element and a second spring arm coupled to the setting arm via a coupling device comprising a cam disc with a setting contour in contact with the setting arm, and wherein the flat sheet metal spring is elastically supported against the base element and the setting arm and elastically deformed in the plate plane of the flat sheet metal such that the coupling device with the cam disc holds and maintains the lid in any position between the open position and the closed position.

20. The lid stay according to claim 19, wherein the coupling device comprises a pressure element in the form of a roller which is acted upon by a force of the flat spring against the setting contour.

* * * * *